United States Patent [19]

Watanabe et al.

[11] Patent Number: 4,895,826

[45] Date of Patent: Jan. 23, 1990

[54] HEAT-SENSITIVE RECORDING MATERIAL WITH DIAZONIUM SALT AND COUPLER PRECURSOR WITH ESTER OR URETHANE GROUP

[75] Inventors: Katsuhiko Watanabe; Takayuki Hayashi; Hiroshi Kamikawa; Masato Satomura; Takekatsu Sugiyama, all of Shizuoka, Japan

[73] Assignee: Fuji Photo Film Co., Ltd., Kanagawa, Japan

[21] Appl. No.: 185,230

[22] Filed: Apr. 25, 1988

[30] Foreign Application Priority Data

Apr. 24, 1987 [JP] Japan ..... 62-101456

[51] Int. Cl.[4] ..... B41M 5/18; G03C 1/58

[52] U.S. Cl. ..... 503/202; 430/138; 430/151; 430/171; 430/180; 430/181; 430/182; 503/214; 503/218

[58] Field of Search ..... 430/138, 151, 171, 180, 430/181, 182; 503/202, 214, 218

[56] References Cited

U.S. PATENT DOCUMENTS

| | | | |
|---|---|---|---|
| 3,202,510 | 8/1965 | Hollmann | 430/151 |
| 3,899,335 | 8/1975 | Przezdziecki | 430/151 |
| 4,307,170 | 12/1981 | Desjarlais | 430/180 |
| 4,314,015 | 2/1982 | Hashimoto et al. | 430/58 |
| 4,439,512 | 3/1984 | Ceintrey | 430/180 |
| 4,487,826 | 12/1984 | Watanabe et al. | 430/151 |
| 4,644,376 | 2/1987 | Usami et al. | 430/180 |

OTHER PUBLICATIONS

Sato, H., et al., *Journal of Imaging Technology,* vol. 11, No. 3, pp. 137–142, 6/1985.

*Primary Examiner*—Charles L. Bowers, Jr.
*Attorney, Agent, or Firm*—Sughrue, Mion, Zinn, Macpeak & Seas

[57] ABSTRACT

A heat-sensitive recording material is disclosed, which comprises a support having thereon a heat-sensitive recording layer comprising a diazo compound and a coupler precursor compound, said coupler precursor compound being capable of forming a compound having an ability of coupling with said diazo compound upon heating.

11 Claims, No Drawings

HEAT-SENSITIVE RECORDING MATERIAL WITH DIAZONIUM SALT AND COUPLER PRECURSOR WITH ESTER OR URETHANE GROUP

FIELD OF THE INVENTION

The present invention relates to a heat-sensitive recording material, and in particular, to a diazo series heat-sensitive recording material.

BACKGROUND OF THE INVENTION

In general, leuco color-forming type heat-sensitive recording materials are used as those for heat-sensitive recording methods. However, the heat-sensitive recording materials have a drawback in that an unexpected part is often colored by severe handling after recording or by heat or adhesion of solvents, so that the images recorded would be stained. Recently, diazo series heat-sensitive recording materials have been studied as heat-sensitive recording materials which are free from the above noted drawback. For example, as illustrated in Japanese Patent Application (OPI) No. 123086/82 (the term "OPI" as used herein means a "published unexamined Japanese patent application"), *Journal of Image Electronics Association of Japan,* 11, 290 (1982), a recording material comprising a diazo compound, a coupling component and a basic component (including a substance capable of becoming basic under heat) is recorded under heat and then exposed to light so as to decompose the non-reacted diazo compound to stop the coloration. It is possible, in accordance with the recording method, to stop the coloration of the part which is unnecessary to be recorded (hereinafter referred to as "fixation"). However, pre-coupling gradually proceeds also in the recording material during storage so that the material is defectively and unfavorably colored (fogged).

In order to overcome this defect, Japanese Patent Application (OPI) No. 190886/84, discloses providing a heat-sensitive recording material comprising microcapsules, which contain at least one component participating in a color-forming reaction as a core substance, coated with a wall formed by polymerization therearound.

However, even the heat-sensitive recording material formed by this method is often stained because of pre-coupling during storage. In addition, a more rapid heat-responsibility is required for the recording material. Accordingly, improvement of known heat-sensitive recording materials is desired in this technical field.

SUMMARY OF THE INVENTION

An object of the present invention is to provide a diazo series heat-sensitive recording material which has excellent shelf stability and which has a rapid heat-responsibility and a high color-forming property under heat, it is also desired that the recorded material be almost free from a reduction in the recorded image density even after storage for a long period of time.

The above-noted object of the present invention is attained by a heat-sensitive recording material comprising a support having thereon a heat-sensitive recording layer comprising a diazo compound and a coupler precursor compound, the coupler precursor compound being capable of forming a compound having an ability of coupling with the diazo compound upon heating.

DETAILED DESCRIPTION OF THE INVENTION

The "coupler precursor compound capable of forming a compound having an ability of coupling with the diazo compound upon heating" for use in the present invention, includes a temporarily non-activated coupler of phenols, naphthols, 5-pyrazolones, β-keto-acid amides, β-keto-acid esters, etc., in which the hydroxyl group has been converted into an ester bond or a urethane bond.

Preferred among the above-noted couplers are, for example, resorcinol, phloroglucinol, sodium 2,3-dihydroxynaphthalene-6-sulfonate, 1-hydroxy-2-naphthoic acid morpholinopropylamide, 1,5 dihydroxynaphthalene, 2,3-dihydroxynaphthalene, 2,3-dihydroxy-6-sulfanylnaphthalene, 2-hydroxy-3-naphthoic acid morpholinopropylamide, 2-hydroxy-3-naphthoic acid anilide, 2-hydroxy-3-naphthoic acid-α-naphthylamide, 2-hydroxy-3-naphthoic acid-β-naphthylamide, 2-hydroxy-3-naphthoic acid-3'-nitrobenzamide, 2-hydroxy-3-naphthoic acid-4'-chlorobenzamide, 2-hydroxy-3-naphthoic acid-2'-methoxybenzamide, 2-hydroxy-3-naphthoic acid-2'-ethoxybenzamide, 2-hydroxy-3-naphthoic acid-2',5'-dimethoxybenzamide, 2-hydroxy-3-naphthoic acid-4'-chloro-2'-methylamide, Naphthol AS-GR, Naphthol DB, 2-hydroxycarbazole-3-carboxylic acid-4'-chlorobenzamide, 4,4'-bis(α-acetylacetylamino)-3,3'-dimethylbiphenyl, 2-hydroxy-3-naphthoic acid-2'-methylanilide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetacetanilide, benzoylacetanilide, 1-phenyl 3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, etc. In particular, phenols or naphthols having one or more electron-attracting groups, such as an alkoxycarbonyl group, a substituted carbamoyl group, a substituted sulfamoyl group, a halogen atom, a nitro group, a cyano group, etc., or having a hydroxyl group, a substituted amino group, etc., are especially preferred among the couplers.

The coupler precursor compounds preferably used in the present invention are represented by formula (I):

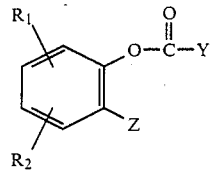

(I)

wherein X represents an oxygen atom or a sulfur atom; Y represents an alkyloxy group, an aryloxy group, a substituted amino group, an alkylthio group, an arylthio group, an alkyl group or an aryl group; Z represents an optionally mono- or di-substituted carbamoyl group, an optionally N-mono- or N-di-substituted sulfamoyl group or an alkyl- or aryl-oxycarbonyl group; and $R_1$ and $R_2$, which may be the same or different, each represents a hydrogen atom, a halogen atom, a hydroxyl group, a substituted amino group, an alkyl group or an aryl group, or $R_1$ and $R_2$ may be bonded to form a ring.

When the substituent for X, Z, $R_1$ or $R_2$ of formula (I) further has one or more substituents, they include an alkyl group, an aryl group, an aralkyl group, etc.

Preferred examples of the compounds are set forth below:

(1) 2-n-Butylaminocarbonyloxy-3-phenylcarbamoylnaphthalene (2) 2-n-Octylaminocarbonyloxy-3-phenylcarbamoylnaphthalene (3) 2-Cyclohexylaminocarbonyloxy-3-phenylcarbamoylnaphthalene (4) 2-Octadecylaminocarbonyloxy-3-phenylcarbamoylnaphthalene (5) 2-Diethylaminocarbonyloxy-3-phenylcarbamoylnaphthalene (6) 2-n-Octylaminothiocarbonyloxy-3-phenylcarbamoylnaphthalene (7) 2-Benzyloxycarbonyloxy-3-(2,6-dimethylphenyl)-carbamoylnaphthalene (8) 2-Benzyloxycarbonyloxy-3-n-butylphenylcarbamoylnaphthalene (9) 2-n-Butylthiocarbonyloxy-3-phenylcarbamoylnaphthalene

(10) 2-Benzyloxycarbonyloxy-3-morpholinocarbonylnaphthalene

(11) 2-Acetyloxy-3-phenylcarbamoylnaphthalene

(12) 2-Propionyloxy-3-phenylcarbamoylnaphthalene

The examples set forth above are not intended to limit the scope of the present invention. Also, these compounds can be used in combination of two or more, or can also be used in combination with the above-noted conventional couplers.

The diazo compounds for use in the present invention are diazonium salts of formula (II):

$$ArN_2^+X^- \quad (II)$$

wherein Ar represents an aromatic group moiety; $N_2^+$ represents a diazonium group; and $x^-$ represents an acid anion.

These compounds can be colored after being coupled with a coupling component, and can further be decomposed with a light.

The preferred aromatic group moiety represented by Ar of formula (II), is represented by formula (III):

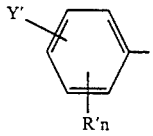

(III)

wherein Y' represents a hydrogen atom, a substituted amino group, an alkoxy group, an aryloxy group, an arylthio group, an alkylthio group or an acylamino group; R' represents a hydrogen atom, an alkyl group, an alkoxy group, an aryloxy group, an arylamino group or a halogen atom (e.g., I, Br, Cl, F); and n represents 1 or 2. The substituted amino group for Y' is preferably a The substituted amino group for Y' is preferably a monoalkylamino group, a dialkylamino group, an arylamino group, a morpholino group, a piperidino group, a pyrrolidino group, etc.

Specific examples of the salt-forming diazonium group of formula (II) include, 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, 4-diazo-1-pyrrolidino-2-ethylbenzene, etc.

Specific examples of the acid anions of formula (II) include $C_nF_{2n+1}COO^-$ (wherein n is an integer of from 3 to 9), $C_mF_{2m+1}SO_3^-$ (wherein m is an integer of from 2 to 8), $(C_lF_{2l+1}SO_2)_2CH^-$ (wherein l is an integer of from 1 to 18), $C_pF_{2p-1}COO^-$ (wherein p is an integer of from 3 to 9),

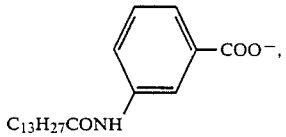

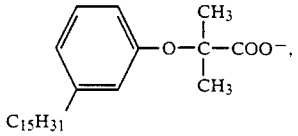

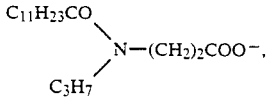

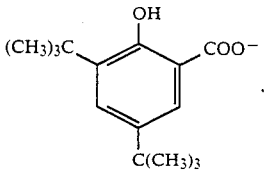

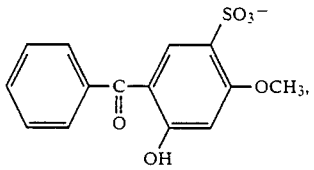

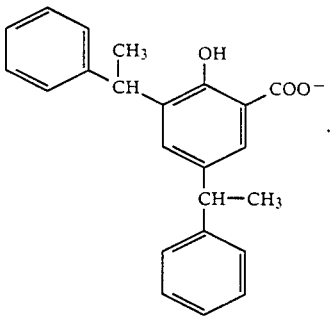

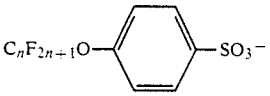

-continued (wherein n is an integer of 3 to 9),

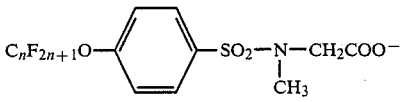

(wherein n is an integer of 3 to 9),

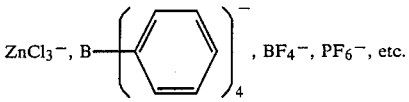

In particular, a perfluoroalkyl group-containing anion, a perfluoroalkenyl group-containing anion or $PF_6^-$, is especially preferred as the acid anion, since the anion is effective for inhibiting the increase of fog during storage of the recording materials.

Specific examples of the diazo compounds (i.e., diazonium salts) for use in the present invention are set forth below, however, these examples are not intended to limit the scope of the present invention.

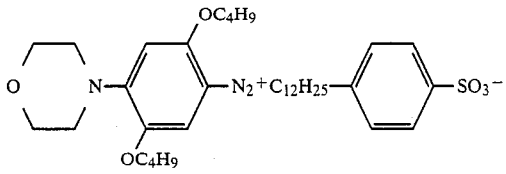

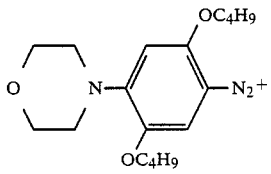

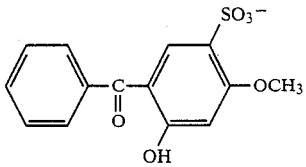

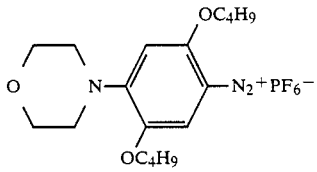

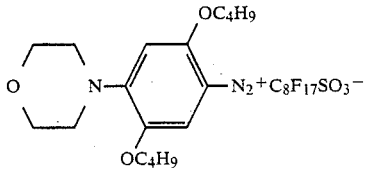

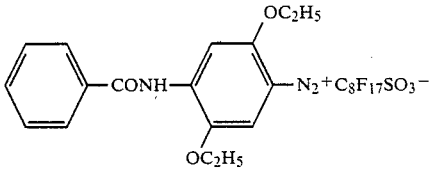

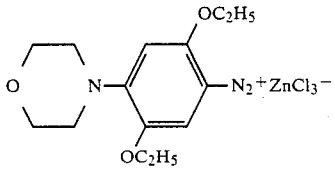

-continued

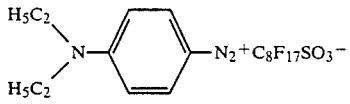

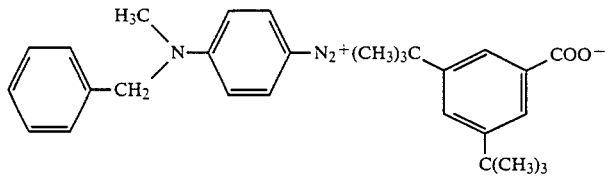

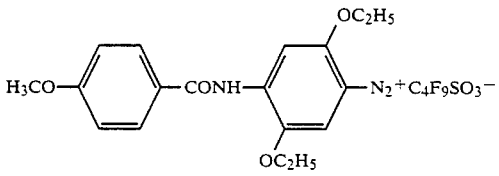

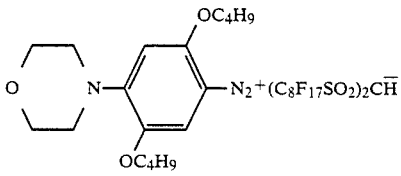

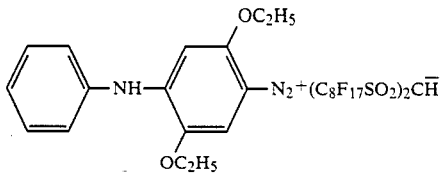

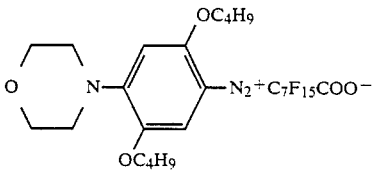

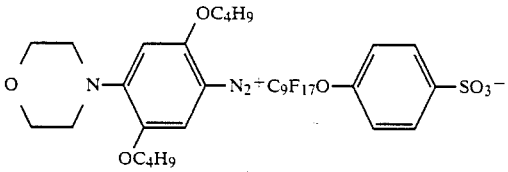

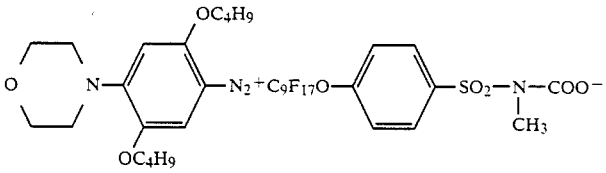

A basic substance is preferably added to the heat-sensitive recording material of the present invention, so as to accelerate the color formation. Also, as the above-noted basic substance, a sparingly water soluble or water-insoluble basic substance, or a basic substance capable of forming an alkali under heat, is to be used.

Examples of the above-noted basic substance, include nitrogen-containing compounds such as inorganic or organic ammonium salts, organic amines, amides, ureas, thioureas, isothioureas and derivatives thereof, as well as thiazoles, pyrroles, pyrimidines, piperazines, guanidines, indoles, imidazoles, imidazolines, triazoles, morpholines, piperidines, amidines, formamidines, pyridines, etc. Among these, compounds having a melting point or decomposition point of 60° C. or higher are especially preferred.

Specific examples of such compounds are, for example, ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine-trichloroacetic acid salt, N,N'-dibenzylpiperazine, 4,4'-dithiomorpholine, morpholinium trichloroacetic acid salt, 2-amino-benzothiazole, 2-benzoylhydrazino-benzothiazole, etc. These basic substances can be used in a combination of two or more, if desired.

In the present invention, it is preferred to optionally add to the heat-sensitive recording layer (color-forming layer) of the recording material at least one or more substances selected form aromatic ethers or esters, alcohols, phenols, sulfonamides and acid amides, for the purpose of improving the shelf stability, improving the color forming property under heat and inhibiting the decrease of the optical density of the images formed by heat-recording during storage for a long period of time.

The aromatic ethers are represented by the formula: Ar—O—R, wherein Ar represents an aromatic group and R represents a non-aromatic group.

Specific examples thereof are as follows:

(1) 2-Benzyloxynaphthalene
(2) 1-p-Biphenyloxy-2-phenylethane
(3) 2-p-Chlorobenzyloxynaphthalene
(4) 1,2-Diphenoxyethane
(5) 1-Phenoxy-2-p-chlorophenoxyethane
(6) p-Biphenyl-$\beta$-methoxyethylether
(7) p-Biphenyl-$\beta$-cyclohexyloxyethylether The aromatic esters are represented by the following formulae:

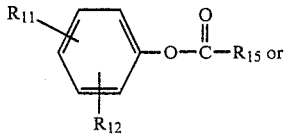

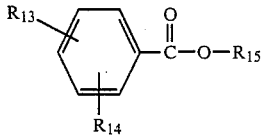

In these formulae, $R_{11}$ and $R_{12}$, or $R_{13}$ and $R_{14}$ may be the same or different, and each represents a hydrogen atom, an alkyl group, an alkoxy group, an aryloxy group, an acyl group, a halogen atom, a cyano group, an aryl group, an alkyloxycarbonyl group, or an aryloxycarbonyl group; and $R_{11}$ and $R_{12}$, or $R_{13}$ and $R_{14}$ may be bonded to each other to form a ring: $R_{15}$ represents an alkyl group having from 1 to 10 carbon atoms, which can optionally be substituted by an alkoxy group, an aryloxy group, a halogen atom or an aryl group, or an aryl group having from 6 to 12 carbon atoms, which can optionally be substituted by an alkyl group, an alkoxy group, a hydroxyl group or a halogen atom.

Specific examples of the ester compounds include the following compounds:

(1) 2-Benzoyloxynaphthalene
(2) 1,2-Bis($\beta$-phenoxyethoxycarbonyl)ethane
(3) 1,4-Bis($\beta$-phenoxyethoxycarbonyl)butane
(4) 1-p-Methylbenzoyloxy-2-p-biphenyloxyethane
(5) 1-Hydroxy-2-phenoxycarbonylnaphthalene Examples of the alcohols are those represented by formula:

$R_{16}$—OH wherein $R_{16}$ represents an alkyl group, which may optionally be substituted and which may be linear, branched or cyclic and which may optionally be unsaturated. The substituents for the alkyl group may be one or more selected from a halogen atom, an acyl group, an alkoxy group, a hydroxyl group, an aryl group, an aryloxy group, an alkoxycarbonyl group, an acylamino group, a cyano group, a nitro group and an acyloxy group.

Specific examples of the alcohols are as follows:

(1) p-Xylenol
(2) m-Xylenol
(3) Hydroxybenzyl alcohol
(4) Hydroxyphenethyl alcohol
(5) p-Methoxyphenoxyethanol
(6) Perhydrobisphenol A
(7) Naphthylene-diol
(8) Methylxylylene-diol
(9) Methoxyxylylene-diol The phenols are represented by the formula Ar—OH, wherein Ar represents an aromatic group. Specific examples thereof are set forth below.

(1) p-t-Butylphenol
(2) p-t-Octylphenol
(3) p-$\alpha$-Cumylphenol
(4) p-t-Pentylphenol
(5) 2,5-Dimethylphenol
(6) 2,4,5-Trimethylphenol
(7) 3-Methyl-4-isopropylphenol
(8) p-Benzylphenol
(9) o-Cyclohexylphenol
(10) p-(Diphenylmethyl)phenol
(11) p-Benzyloxyphenol The acid amides include carboxylic acid amides and sulfonic acid amides. Arylcarboxylic acid amides and arylsulfonic acid amides are particularly preferred.

Specific examples of arylcarboxylic acid amides are set forth below:

(1) Benzamide
(2) Ethylbenzamide
(3) Isopropylbenzamide
(4) Dimethylbenzamide
(5) Chlorobenzamide
(6) Methocybenzamide Specific examples of sulfonic acid amides are set forth below:

(1) Ethylbenzenesulfonamide
(2) o-Toluenesulfonamide
(3) o-Methoxybenzenesulfonamide
(4) Chlorobenzenesulfonamide
(5) Ethoxybenzenesulfonamide
(6) p-Toluenesulfonamide When the heat-sensitive recording paper of the present invention is formed by a microcapsulation method, the core substance for the microcapsules is first dissolved or dispersed in a water insoluble organic solvent and emulsified, and then microcapsule wall is formed around the core substance emulsion. As the organic solvents for use in the method, those having a boiling point of 80° C. or higher are preferred. Specifically, phosphoric acid esters, phthalic acid esters and other carboxylic acid esters, as well as fatty acid amides, alkylated biphenyls, alkylated terphenyls, chlorinated paraffins, alkylated naphthalenes, diarylethanes, etc. can be used. Specific examples of the solvents include tricresyl phosphate, trioctyl phosphate, octyldiphenyl phosphate, tricyclohexyl phosphate, diethyl phthalate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, chlorinated paraffin, diisopropylnaphthalene, 1,1'-ditolylethane, 2,4-ditert-aminophenol, N,N-dibutyl-2-butoxy-5-tert-octylaniline, etc.

Among them, dibutyl phthalate, tricresyl phosphate, diethyl phthalate and dibutyl maleate, are especially preferred.

The microcapsules are formed by first emulsifying a reactive substance-containing core material, and then forming high polymer substance walls around the resulting oil drops. The reactants for forming the high polymer substance are added to the inside of the oil drops and/or the outside of the oil drops. Specific examples of the high polymer substance include, polyurethanes, polyureas, polyamides, polyesters, polycarbonates, urea-formaldehyde resins, melamine resins, polystyrenes, styrenemethacrylate copolymers, styrene-acrylate copolymers, gelatins; polyvinyl pyrrolidones, polyvinyl alcohols, etc.

The above-noted high polymer substances can be used in combinations of two or more. Preferred high polymer substances are polyurethanes, polyureas, polyamides, polyesters and polycarbonates. Polyurethanes and polyureas are especially preferred.

For formation of the microcapsule walls, a microencapsulation method where the walls are formed by polymerization of the reactants from the inside of the oil drops is highly effective and therefore, is especially preferred. By this method, microcapsules which have a uniform grain size and which are preferred for forming a recording material having an excellent shelf stability can be formed in a short period of time.

The details of the microencapsulation method and the compounds to be used for the method are described in U.S. Pat. Nos. 3,726,804 and 3,796,669.

For example, when a polyurethane is to be used as the material for capsule walls, a polyvalent isocyanate and another substance which may react with the isocyanate to form the intended capsule wall (for example, polyols) are blended in an oily liquid to be encapsulated. The resulting mixture is then emulsified and dispersed in water, and then the temperature is elevated, whereby a microcapsule wall is formed in the oil drop interface through the high polymer formation reaction.

The polyisocyanates and the other polyols and polyamines which react with the polyisocyanates, which are to be used in the reaction, are illustrated in U.S. Pat. Nos. 3,281,383, 3,773,695 and 3,793,268, Japanese Patent Publication Nos. 40347/73 and 24159/74 and Japanese Patent Application (OPI) Nos. 80191/73 and 84086/73. These can be used for the practice of the present invention.

In addition, tin salts can be used together with the compounds described herein above.

Specifically, it is preferred to use a polyvalent isocyanate as the first wall-forming substance and a polyol as the second wall-forming substance, since the shelf stability of the resulting recording material is improved. Both may be combined so as to freely vary the heat permeability of the reactive substance.

Specific examples of the polyvalent isocyanates, which are the first wall-forming substances, include diisocyanates such as m-phenylene diisocyanate, p-phenylene-diisocyanate, 2,6,-tolylene-diisocyanate, 2,4-tolylene-diisocyanate, naphthalene-1,4-diisocyanate, diphenylmethane-4,4'-diisocyanate, 3,3'-dimethoxy-4,4'-biphenyl-diisocyanate, 3,3'-dimethyldiphenylmethane-4,4'-diisocyanate, xylylene-1,4-diisocyanate, 4,4'-diphenylpropane-diisocyanate, trimethylene-diisocyanate, hexamethylene-diisocyanate, propylene-1,2-diisocyanate, butylene-1,2-diisocyanate, cyclohexylene-1,2-diisocyanate, cyclohexylene-1,4-diisocyanate, etc.; triisocyanates such as 4,4',4''-triphenylmethane-triisocyanate, toluene-2,4,6-triisocyanate, etc.; tetraisocyanates such as 4,4'-dimethyldiphenylmethane-2,2',5,5'-tetraisocyanate, etc.; and isocyanate prepolymers such as hexamethylenediisocyanate/trimethylolpropane adduct, 2,4-tolylenediisocyanate/trimethylolpropane adduct, xylylenediisocyanate/trimethylolpropane adduct, tolylene diisocyanate/hexanetriol adduct, etc.

Specific examples of the polyols, which are the second wall-forming substances, include aliphatic or aromatic polyvalent alcohols, hydroxypolyesters, hydroxypolyalkyleneethers, etc. Preferred examples of the polyols include ethylene glycol, 1,3-propanediol, 1,3-butane-diol, 1,5-pentane-diol, 1,6-hexane-diol, 1,7-heptane-diol, 1,8-octane-diol, propylene glycol, 2,3-dihydroxybutane, 1,2-dihydroxybutane, 1,3-dihydroxybutane, 2,2 dimethyl-1,3-propane-diol, 2,4-pentane-diol, 2,5-hexane-diol, 3-methyl-1,5-pentane-diol, 1,4-cyclohexanedimethanol, dihydroxycyclohexane, diethylene glycol, 1,2,6-trihydroxyhexane, phenylethylene glycol, 1,1,1-trimethylolpropane, hexanetriol, pentaerythritol, glycerin; aromatic polyhydric alcohol-alkylene oxide condensation products such as 1,4-di(2-hydroxyethoxy)benzene, resorcinol-dihydroxyethylether, etc.; p-xylylene glycol, m-xylylene glycol, α,α'-dihydroxy-p-diisopropylbenzene, etc.

In addition, 4,4'-dihydroxy-diphenylmethane, 2-(p,p'-dihydroxydiphenylmethyl)benzyl alcohol, bisphenol A-ethylene oxide adduct, bisphenol A-propylene oxide adduct, etc. may also be employed. The polyol is preferably used in a proportion of from 0.02 to 2 mols as the hydroxyl group per mol of the isocyanate group.

For formation of the microcapsules to be used in the present invention, a water-soluble polymer can be used, which may be water-soluble anionic polymers, nonionic polymers and ampholytic polymers. As the anionic polymers, either natural or synthetic anionic polymers can be used. For example, polymers having $-COO^-$, $-SO_3^-$, etc. may be used. Specific examples of natural anionic polymers include gum arabic, alginic acid, etc.; and specific examples of semi-synthetic anionic polymers include carboxymethyl cellulose, phthalated gelatin, sulfated starch, sulfated cellulose, lignin sulfonic acid, etc.

As synthetic anionic polymers, maleic anhydride series copolymers (including hydrolyzed ones), acrylic acid series polymers and copolymers (including methacrylic acid series ones), vinylbenzenesulfonic acid series polymers and copolymers, carboxyl-modified polyvinyl alcohols, etc. may be used.

Examples of the nonionic polymers include polyvinyl alcohol, hydroxyethyl cellulose, methyl cellulose, etc.

Gelatin is typical as the ampholytic polymer compound.

These water soluble polymers are used in the form of an aqueous solution having a concentration of from 0.01 to 10 wt %. The grain size of the microcapsules is adjusted to 20 μm or less. In general, if the grain size is larger than 20 μm, the printed image quality in the recording material would be poor.

In particular, when the material is to be heated with a thermal head from the side of the coating layer, the grain size of the microcapsules is preferably 8 μm or less, so as to evade the formation of pressure marks.

Any one or both of the diazo compound and coupler precursor compound, which are the main components of the material of the present invention, can be encapsulated in the microcapsule core. When both of the components are encapsulated as the core of the microcapsules, these components can be encapsulated together in the same microcapsule, or separately in different microcapsules. When the above-noted basic substance is used in the material of the present invention, these three components (i.e., the diazo compound, coupler precursor compound and basic substance) cannot be encapsulated together in the same microcapsule, but various combinations can be employed for the encapsulation. The other component(s) which are not encapsulated as the core of the microcapsules are incorporated into the heat-sensitive layer, which is outside the microcapsules.

Therefore, the compounds of the present invention can be either in the core of the microcapsules or outside the microcapsules.

For formation of the microcapsules, the components to be encapsulated may be prepared in the form of an emulsion containing the components in a concentration of 0.2 wt % or more.

The diazo compound and coupler precursor for use in the present invention can be incorporated either in the core of the microcapsules or in the heat-sensitive layer which is outside the microcapsules. It is preferred that the coupler precursor component is contained in an amount of from 0.1 to 10 parts by weight per one part by weight of the diazo compound. The amount of the diazo compound to be coated is preferably from 0.05 to 5.0 g/m$^2$.

When the basic substance is used, it also can be incorporated either in the core of the microcapsules or in the heat-sensitive layer which is outside the microcapsules. It is preferred that the basic substance is contained in an amount of from 0.1 to 20 parts by weight per one part by weight of the diazo compound.

When the diazo compound and coupler precursor component, and optionally the basic substance of the present invention are not encapsulated in the core of the microcapsules, it is preferred that these components are dispersed as solids together with a water-soluble polymer, for example, with a sand mill, etc. As preferred water-soluble polymers for this dispersion, the aforesaid water-soluble polymers to be used for the formation of the microcapsules may also be employed. The concentration of the water-soluble polymer to be used for the dispersion is preferably from 2 to 30 wt %, and the diazo compound and coupler precursor component, and optionally the basic substance are incorporated in the water-soluble polymer solution each in a concentration of from 5 to 40 wt %.

The grain size of the resulting dispersion is preferably 10 μm or less.

The heat-sensitive recording layer of the material of the present invention may be either a single layer or a multi-layer, comprising a diazo layer and a coupler precursor layer, individually.

For the purpose of improving the heat-sensitivity (i.e., the color forming capacity under heat) of the heat-sensitive recording material of the present invention, carbamic acid ester compounds and aromatic methoxy compounds can further be added to the material. It is believed that these compounds lower the melting point of the coupler precursor component or the basic substance or improve the heat-permeability of the microcapsule walls, where the practical density of the material would be elevated.

Specific examples of the carbamic acid ester compounds include ethyl N-phenylcarbamate, benzyl N-phenylcarbamate, phenethyl N-phenylcarbamate, benzyl carbamate, butyl carbamate, isopropyl carbamate, etc. Specific examples of the aromatic methoxy compounds include 2-methoxybenzoic acid, 3,5-dimethoxyphenylacetic acid, 2-methoxynaphthalene, 1,3,5-trimethoxybenzene, p-benzyloxymethoxybenzene, etc.

In any case, the amount of the compound to be used is from 0.01 to 10 parts by weight, preferably from 0.1 to 5 parts by weight, per one part by weight of the coupler precursor component, and the amount can appropriately be determined in order to adjust the desired color density.

The heat-sensitive recording material of the present invention can further contain a free radical generating agent (i.e., a compound capable of generating free radical by light irradiation) which is generally used in photo-polymerizing compositions, etc., for the purpose of reducing the yellow-staining in the background part of the material after photo-fixing. Examples of the free radical generating agents include aromatic ketones (e.g., benzophenone, 4,4'-bis(dimethylamino)benzophenone, 4,4'-bis(diethylamino)benzophenone, 4-methoxy-4'-(dimethylamino)benzophenone, 4,4'-dimethoxybenzophenone, 4-dimethylaminobenzophenone, 4-methoxy-3,3'-dimethylbenzophenone, 1-hydroxycyclohexylphenylketone, 4dimethylaminoacetophenone, 2-methyl-1-[4-(methylthio)phenyl]-2-morpholino-propanone-1-acetophenone, etc.); cyclic aromatic ketones (e.g., fluorenone, anthrone, xanthone, thioxanthone, 2-chlorothioxanthone, 2,4-dimethylthioxanthone, 2,4-diethylthioxanthone, acridone, N-ethylacridone, benzanthrone, etc.); quinones (e.g., benzoquinone, 2,3,5-trimethyl-6-bromobenzoquinone, 2,6-di-n-decylbenzoquinone, 1,4-naphthoquinone, 2-isopropoxy-1,4-naphthoquinone, 1,2-naphthoquinone, anthraquinone, 2-chloro-anthraquinone, 2-methylanthraquinone, 2-tertbutylanthraquinone, phenanthraquinone, etc.); benzoin; benzoin ethers (e.g, benzoin methyl ether, benzoin ethyl ether, 2,2-dimethoxy-2-phenylacetophenone, α-(methylolbenzoin methyl ether, etc.); aromatic polycyclic hydrocarbons (e.g., naphthalane, anthracene, phenanthrene, pyrene, etc.); azo compounds (e.g., azobisisobutyronitrile, α-azo-1-cyclohexane-carbonitrile, azobisisovaleronitrile, etc.); organic disulfides (e.g., thiuram disulfide, etc.); acyloxime esters (e.g., benzyl-(o-ethoxycarbonyl)-o-monooxime, etc.); etc.

The amount of the free radical generating agent to be added is preferably from 0.01 to 5 parts by weight, and more preferably from 0.1 to 1 part by weight, per one part by weight of the diazo compound.

The free radical generating agent can be encapsulated together with the diazonium salt to form the core of the microcapsules, whereby the yellow-staining of the background part of the material, after photo-fixing can be reduced.

Further, the heat-sensitive recording material of the present invention can also contain an ethylenic unsaturated bond containing polymerizable compound (hereinafter referred to as a "vinyl monomer"), for the purpose of reducing the yellow-staining of the background part of the material after photo-fixing. The vinyl monomer is a compound having at least one ethylenic unsaturated bond (e.g., a vinyl group, vinylidene group, etc.), in the chemical structure. This compound may have various chemical forms, including a monomer, prepolymers or a dimer, trimer and other oligomers as well as mixtures thereof and copolymers thereof. Examples of the vinyl monomer include unsaturated carboxylic acids and salts thereof, esters of unsaturated carboxylic acids and aliphatic polyhydric alcohol compounds, amides of unsaturated carboxylic acids and aliphatic polyamine compounds, etc.

The vinyl monomer is used in a proportion of from 0.2 to 20 parts by weight, and preferably from 1 to 10 parts by weight, per one part by weight of the diazo compound.

The vinyl monomer is incorporated into the core of the microcapsules, together with the diazo compound, whereupon a part or all of the organic solvent, which is used as the solvent (or dispersion medium) for the core substance, can be replaced by the vinyl monomer.

When the diazo compound is incorporated in the core of the microcapsules in the heat-sensitive recording material of the present invention, the material may contain a coupling reaction-deactivating agent in the outside of the microcapsules, so that the diazo compound existing in the liquid phase or the diazo compound in incomplete microcapsules (that is, the diazo compound which is not completely blocked by the capsule wall), may react with the coupling reaction-deactivating agent to lose the coupling reactivity (color-formimg reactivity) of the compound. Therefore, the material can be prevented from fogging.

The coupling reaction-deactivating agent may be any substance which can reduce the coloration of the solution containing the diazo compound dissolved therein. For the selection of the appropriate coupling reaction-deactivating agent, the diazo compound is first dissolved in water or an organic solvent, and a compound (i.e., the agent), as dissolved in water or an organic solvent, is added to the previously prepared diazo compound solution and the variation of the color of the diazo compound is observed.

Concretely, hydroquinone, sodium bisulfite, potassium sulfite, hypophosphorous acid, stannous chloride, formalin, etc., can be used as the coupling reaction-deactivating agent. In addition, the coupling reaction-deactivating agent can also be selected from the compounds descibed in K. H. Saunders, *The Aromatic Diazo Compounds and Their Technical Applications,* (London, 1949), pages 105–306.

Preferably, the coupling reaction-deactivating agent itself has little coloration and few side-effects. More preferably, this is a water-soluble substance.

The coupling reaction-deactivating agent is used in such amount that may not interfere with the thermal color-formation reaction of the diazo compound. In general, the deactivating agent is used in an amount of from 0.01 to 2 mols, and preferably from 0.02 to 1 mol, per mol of the diazo compound.

The coupling reaction-deactivating agent of the present invention is, after being dissolved in a solvent, added to a dispersion of the diazo compound-containing microcapsules, or a dispersion of the coupler precursor component or basic substance, or a mixture of these dispersions. Preferably, the deactivating agent is used in the form of an aqueous solution.

The heat-sensitive recording material of the present invention can optionally contain a pigment of silica, barium sulfate, titanium oxide, aluminium hydroxide, zinc oxide, calcium carbonate, etc., or a fine powder of styrene beads, urea-melamine resin, etc., for the purpose of preventing sticking and improving the writability of the recording material.

In addition, metallic soaps can also be used for the prevention of sticking. The amount of the additives to be used is from 0.2 to 7 g/m$^2$.

Further, the heat-sensitive recording material of the present invention can contain a heat-fusible substance, to elevate the thermal recording density. The heat-fusible substance is a substance which is solid at room temperature, but can melt under heat by thermal head and has a melting point of from 50° to 150° C. The substance can dissolve the diazo compound, coupler precursor component and basic substance of the recording material of the present invention. The heat-fusible substance is used in the form of a dispersion having a grain size of from 0.1 to 10 $\mu$m. The amount of the heatfusible substance to be added is from 0.2 to 7 g/m$^2$, as the solid content. Specific examples of the heat-fusible substance include N-substituted fatty acid amids, ketone compounds, urea compounds, esters, etc.

The coating composition can be coated on a support by the action of an appropriate binder to form the heat-sensitive recording material of the present invention.

As the above-noted binder, various emulsions of polyvinyl alcohol, methyl cellulose, ethyl cellulose, carboxymethyl cellulose, hydroxypropyl cellulose, gum arabic, gelatin, starch and derivatives thereof, polyvinyl pyrrolidone, polystyrene, polyacrylamide, polyester, casein, styrene-butadiene latex, acrylonitrile-butadiene latex, polyvinyl acetate, polyacrylate, ethylene-vinyl acetate copolymer, etc., may be used. The amount of the binder to be used, is from 0.5 to 5 g/m$^2$, as the solid content.

In addition to the above-mentioned components, an acid stabilizer, such as citric acid, tartaric acid, oxalic acid, boric acid, phosphoric acid, pyrophosphoric acid, etc., can be added to the recording material of the present invention.

For manufacture of the heat-sensitive recording material of the present invention, a coating composition containing the diazo compound and coupler precursor component, and optionally the basic substance and other additives is first prepared, and this coating composition is coated on a support, such as paper or a synthetic resin film by bar coating, blade coating, air knife coating, gravure coating, roll coating, spray coating, dip coating, etc., and then dried to form a heat-sensitive layer of from 2.5 to 25 g/m$^2$, as the solid content, on the support. Alternatively, the coupling component, basic substance and other additives are added to the core of microcapsules, or dispersed as solids, or dissolved to form the respective aqueous solutions, and then blended. The thus-prepared coating composition is then coated on a support and dried to form a pre-coat layer of from 2 to 10 g/m$^2$, as the solid content, and then the main component of the diazo compound and other additives are added to the core of microcapsules, dispersed as solids, or dissolved to form the respective aqueous solutions and then blended. The thus-prepared coating composition is then superposed over the previously formed pre-coat layer and dried to form a laminate layer of from 1 to 15 g/m$^2$, as the solid content. In the laminate type heat-sensitive recording material obtained by the latter process, the order of the lamination of the layers may be reversed in comparison to the above-mentioned embodiment. For coating the laminate layers, either simultaneous coating or successive coating of the coating compositions is employable. The laminate type heat-sensitive recording material thus prepared, is especially excellent in the shelf stability for a long period of time.

It is also possible to provide the heat-sensitive layer on the support, via the interlayer described in Japanese Patent Application (OPI) No. 54980/86.

As the paper for the support, a neutral paper sized with a neutral sizing agent, such as an alkylketenedimer, etc., and which has a thermal extraction pH of from 6 to 9 (for example, as described in Japanese Patent Application (OPI) No. 14281/80) is advantageous from the viewpoint of the storage stability.

The paper described in Japanese Patent Application (OPI) No. 116687/82, which satisfies the following formula and which has a Bekk smoothness of 90 seconds or more, is advantageous, in order to prevent the penetration of the coating composition into the paper and to improve the contact of the heat-sensitive recording layer to a recording thermal head.

$$\frac{\text{stockigt sizing degree}}{(\text{meter weighing capacity})^2} \geqq 3 \times 10^{-3}$$

Further, the paper described in Japanese Patent Application (OPI) No. 136492/83, which has an optical surface roughness of 8 μm or less and a thickness of from 40 to 75 μm; the paper described in Japanese Patent Application (OPI) No. 69091/83, which has a density of 0.9 g/cm$^3$ or less and an optical contact ratio of 15% or more; the paper described in Japanese Patent Application (OPI) No. 69097/83, which was made from a pulp as beaten to have a Canadian standard freeness (JIS P8121) of 400 cc or more and which was processed to prevent the penetration of the coating composition; the paper described in Japanese Patent Application (OPI) No. 65695/83, in which the glossy surface of the base paper made by Yankee paper machine is coated with the coating composition for the heat-sensitive recording layer so that the coloring density and the resolving power are improved; the paper described in Japanese Patent Application (OPI) No. 35985/84, in which the base paper was subjected to corona discharge so as to improve the coating aptitude, etc., can be used in the present invention with good results. In addition to these papers, any and every support which is conventionally used in the field of heat-sensitive recording papers can also be used as the support for the recording material of the present invention.

The heat-sensitive recording material of the present invention can be used as printer papers for facsimile machines and computers which require a rapid recording capacity. After being printed under heat, the material may be exposed, so as to decompose the non-reacted diazo compound for fixation. Further, the material can also be used as a heat-development type copying paper.

The following examples are intended to illustrate the present invention but not to limit it in any way. The "part" for the amount of the component to be added means "part by weight" unless otherwise specifically indicated.

EXAMPLE 1

An ethyl acetate solution containing 3.45 parts of the diazo compound having the structural formula mentioned below, 10 parts of 2-acetyloxy-3-phenylcarbamoylnaphthalene and 100 parts of triphenyl guanidine was coated on a paper and then dried at room temperature to obtain a heat-sensitive recording material.

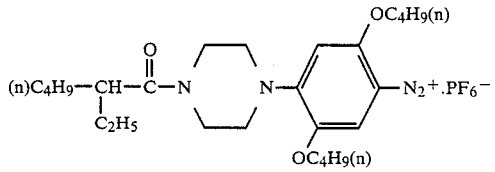

EXAMPLE 2

Another heat-sensitive recording material was prepared in the same manner as Example 1, except that the 2-acetyloxy-3-phenylcarbamoylnaphthalene was replaced by 2-n-butylaminocarbonyloxy-3-phenylcarbamoylnaphthalene.

COMPARATIVE EXAMPLE 1

A comparative heat-sensitive recording material was prepared in the same manner as Example 1, except that the 2-acetyloxy-3-phenylcarbamoylhaphthalene was replaced by 2-hydroxy-3-naphthoic acid anilide.

Among the heat-sensitive recording material samples of the above-mentioned Example 1, Example 2 and Comparative Example 1, the diazo compound, 2-hydroxy-3-naphthoic acid anilide and triphenyl guanidine were rapidly colored in blue at room temperature in the sample of Comparative Example 1. On the contrary, the samples of Example 1 and Example 2 were not colored at all at room temperature, but when heated at about 90° C., these were colored to have an extremely dark blue after 2 to 3 seconds.

The above results indicate that the heat-sensitive recording material samples of the present invention are extremely improved in shelf stability, in particular heat-resistance.

EXAMPLE 3

3.45 parts of the diazo compound set forth below and 18 parts of xylylene-diisocyanate/trimethylolpropane adduct (3/1 by weight) were added to a mixed solvent comprising 6 parts of 1-cyanonaphthalene and 5 parts of ethyl acetate and dissolved under heat. The resulting diazo compound solution was blended with an aqueous solution of 5.2 parts of polyvinyl alcohol as dissolved in 58 parts of water and dispersed by emulsification at 20° C. to obtain an emulsion having a mean grain size of 2.5 μm. 100 parts of water was added to the resulting emulsion and heated up to 60° C. with stirring. After 2 hours, a composition containing microcapsules having the diazo compound in the core was obtained.

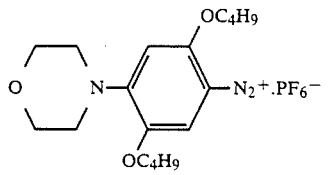

Next, 10 parts of 2-acetyloxy-3-phenylcarbamoylnaphthalene and 10 parts of triphenylguanidine were added to 100 parts of an aqueous 5% polyvinyl alcohol solution and dispersed in a sand mill for about 24 hours to obtain a dispersion comprising the coupler precursor component and the triphenylguanidine, which had a mean grain size of 3 μm.

Further, 20 parts of p-benzyloxyphenol was added to 100 parts of an aqueous 4% polyvinyl alcohol solution and 100 parts of water and dispersed in a paint-shaker for 2 hours to obtain a dispersion having a mean grain size of 3 μm.

Next, 24 parts of the triphenylguanidine dispersion and 28 parts of the p-benzyloxyphenol dispersion were added to 50 parts of the diazo compound capsule composition, obtained as mentioned above, to prepare a coating composition. The coating composition was coated on a smooth woodfree paper (50 g/m$^2$) with a coating bar in dry weight amount of 10 g/m$^2$, and dried at 25° C. for 30 minutes to prepare a heat-sensitive recording material.

EXAMPLE 4

Another heat-sensitive recording material was prepared in the same manner as Example 3, except that the 2-acetyloxy-3-phenylcarbamoylnaphthalene was replaced by 2-n-butylaminocarbonyloxy-3-phenylcarbamoylnaphthalene.

Test Method:

The heat-sensitive recording material samples of Example 3 and Example 4 were recorded under heat with "GIII Mode Thermal Printer" (Hi-fax 700, by Hitachi, Ltd.) and then wholly exposed with "Recopy Super Dry 100" (by Ricoh Company, Ltd.) and fixed. The blue density of the recorded image thus obtained was measured with a Macbeth Reflection Densitometer. Also, the yellow density in the background part was measured in the same manner. The fixed part was again recorded under heat, which resulted in no image recorded in the part. This means that the fixation was complete.

Next, in order to check the shelf stability of the samples, the background density (fog) of the fresh samples and that of the forcedly fatigued samples were measured with a Macbeth Reflection Densitometer, and the variation of the fog therebetween was measured. For the forced fatigue test, the samples were stored in the dark at a temperature of 40° C. and relative humidity of 90% for 24 hours.

Further, in order to measure the lowering of the optical density in the colored part in storage for a long period of time after recording under heat, the images recorded in the respective material samples were stored in the dark at 60° C for 16 hours for the forced fatigue test, and the degree of the lowering of the density of the images in the thus fatigued samples was evaluated. The results obtained are shown in Table 1 below.

TABLE 1

| | Image Density | Lowering of Density After Forced Fatigue Test |
|---|---|---|
| Example 3 | 1.27 | 5% or less |
| Example 4 | 1.26 | 5% or less |

The density of the background part in the fresh samples and the yellowed density of the background part in the fatigued examples were 0.10 or less.

The above results indicate that the heat-sensitive recording material of the present invention is excellent in shelf stability and further, the image density formed in the material is high and the lowering of the density is small after the forced fatigue test.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material, comprising:

a support having provided thereon a heat-sensitive recording layer comprising a diazonium salt which is heat-sensitive and light-decomposable, and a coupler precursor compound, wherein said diazonium salt and said coupler precursor compound are provided in a single layer or a multi-layer such that they are in heat reactive association to enable color formation by coupling, wherein said diazonium salt is present in an amount of from 0.05 to 5.0 g/m$^2$, and said coupler precursor compound is present in an amount of from 0.1 to 10 parts by weight per part by weight of said diazonium salt and is represented by formula (I):

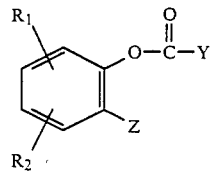

(I)

wherein X represents an oxygen atom; Y represents an alkoxy group, a substituted amino group, an alkylthio group or an alkyl group; Z represents an mono-substituted carbamoyl group or a morpholinocarbonyl group; and $R_1$ and $R_2$ each represents a hydrogen atom, a halogen atom, a hydroxyl group, a substituted amino group, an alkyl group or an aryl group, or $R_1$ and $R_2$ may be bonded to form a ring.

2. A heat-sensitive recording material as in claim 1, wherein said diazonium salt is represented by formula (II):

$$ArN_2^+X^- \quad (II)$$

wherein Ar represents an aromatic group moiety; and $N_2^+$ represents a diazonium group; and $X^-$ represents an acid anion.

3. A heat-sensitive recording material as in claim 1, further containing a basic substance.

4. A heat-sensitive recording material as in claim 3, wherein the basic substance is a nitrogen-containing compound having melting point or decomposition point of at least 60° C.

5. A heat-sensitive recording material as in claim 1, wherein the heat-sensitive recording layer of said recording material contains at least one or more of aromatic ethers, aromatic esters, alcohols, phenols, sulfonamides and acid amides.

6. A heat-sensitive recording material as in claim 1, further containing a free radical generating agent in an amount from 0.01 to 5 parts by weight per one part by weight of said diazonium salt.

7. A heat-sensitive recording material, comprising:

a support having provided thereon a heat-sensitive recording layer formed by a microencapsulation method comprising a diazonium salt which is heat-sensitive and light-decomposable, and a coupler precursor compound, said coupler precursor compound and said diazonium salt are provided in a single layer or a multi-layer such that they are in heat reactive association to enable color formation by coupling, wherein said diazonium salt and said coupler precursor compound are contained in either a core of the microcapsules or in a heat sensitive layer outside the microcapsules, and said diazonium salt is present in an amount of from 0.05 to 5.0 g/m$^2$, and said coupler precursor compound is present in an amount of from 0.1 to 10 parts by weight per part by weight of said diazonium salt and is represented by formula (I):

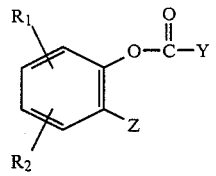

(I)

wherein X represents an oxygen atom; Y represents an alkoxy group, a substituted amino group, an alkylthio group or an alkyl group; Z represents an mono-substituted carbamoyl group or a morpholinocarbonyl group; and $R_1$ and $R_2$ each represents a hydrogen atom, a halogen atom, a hydroxyl group, a substituted amino group, an alkyl group or an aryl group, or $R_1$ and $R_2$ may be bonded to form a ring.

8. A heat-sensitive recording material as in claim 7, further containing a basic substance, wherein said basic substance is contained in either the core of the microcapsules or in the heat-sensitive layer outside the microcapsules, provided that said diazonium salt coupler precursor compound and basic substance are not encapsulated together in the same microcapsule.

9. A heat-sensitive recording material as in claim 8, wherein the basic substance is contained in an amount of from 0.1 to 20 parts by weight of the diazo compound.

10. A heat-sensitive recording material as in claim 7, further comprising a vinyl monomer in an amount of from 0.2 to 20 parts by weight per one part by weight of the said diazonium salt wherein said vinyl monomer is contained in the core of the microcapsules.

11. A heat-sensitive recording material as in claim 7, further comprising a coupling reaction-deactivating agent in an amount of from 0.01 to 2 moles, per mol of said diazonium salt, wherein said coupling reaction-deactivating agent is contained in the heat-sensitive layer outside the microcapsules.

* * * * *